United States Patent [19]

Hampton

[11] 4,113,305

[45] Sep. 12, 1978

[54] RECLINER LEG REST LINKAGE ASSEMBLY

[75] Inventor: Edward L. Hampton, Louisville, Ky.

[73] Assignee: Leggett & Platt, Incorporated, Carthage, Mo.

[21] Appl. No.: 803,955

[22] Filed: Jun. 6, 1977

[51] Int. Cl.[2] ..... A47C 1/02

[52] U.S. Cl. ..... 297/69; 297/85

[58] Field of Search ..... 297/75, 85, 271, 84, 297/83, 88, 69, DIG. 7, 429, 89

[56] References Cited

U.S. PATENT DOCUMENTS

| | | | |
|---|---|---|---|
| 3,099,487 | 7/1963 | Knabusch et al. | 297/DIG. 7 |
| 3,114,573 | 12/1963 | Mizelle | 297/75 |
| 3,128,122 | 4/1964 | Mizelle | 297/88 X |
| 3,141,700 | 7/1964 | Fletcher | 297/DIG. 6 |
| 3,233,938 | 2/1966 | Fletcher | 297/87 |
| 3,475,051 | 10/1969 | Crawford | 297/69 |
| 3,603,641 | 9/1971 | Knabusch | 297/DIG. 7 |
| 3,730,585 | 5/1973 | Rogers, Jr. et al. | 297/85 |
| 3,743,349 | 7/1973 | Crum et al. | 297/85 |
| 3,813,150 | 5/1974 | Katz et al. | 297/85 |

*Primary Examiner*—James T. McCall

*Attorney, Agent, or Firm*—Wood, Herron & Evans

[57] ABSTRACT

A handle actuated leg rest assembly for a recliner chair's movable leg rest. A novel control linkage of the leg rest functions to lock up the leg rest when the leg rest is fully extended or when the leg rest is fully retracted, so that the leg rest does not 'drift' out of either the extended or retracted attitudes after being placed therein. The control and leg rest linkages are locked up in the leg rest extended attitude by positioning certain of the control linkage's links in an over center position relative to the pivot points of those links, and are locked up in the retracted attitude by positioning certain other of the control linkage's links in an over center position relative to the pivot points of those other links.

9 Claims, 6 Drawing Figures

RECLINER LEG REST LINKAGE ASSEMBLY

This invention relates to movable leg rests for recliner chairs. More particularly, this invention relates to a novel handle actuated leg rest linkage assembly.

Movable leg rests for recliner chairs are well known to the prior art. A movable leg rest for a recliner chair may be automatically actuated in response to chair movement or may be handle actuated between an extended or use position, and a retracted or storage position. In the extended position, the leg rest is disposed generally horizontal to floor level, and is usually extended some distance away from and in front of, the front edge of the chair. In the retracted position, the leg rest is disposed generally vertical, and is usually retracted up against the front edge of the chair beneath the seat. With the leg rest in the extended attitude, a user may lean back or recline in the chair and place his legs on the leg rest, thereby orienting the user's legs in an outstretched or generally horizontal position. With the leg rest in the retracted attitude, the user sits in the chair normally with his feet on the floor, thereby permitting the chair to be used in the usual fashion since the leg rest is retracted up against the chair behind the chair user's legs.

One basic type of leg rest linkage assembly, as previously noted, is the manually operated type. In this type of leg rest linkage assembly, the leg rest is connected to the chair's frame by the leg rest linkage assembly, and that linkage assembly is operated by manual means such as, e.g., a handle or crank. In this type leg rest linkage assembly, and when the leg rest is in the fully extended or use position, the leg rest itself may tend to droop or drift back toward the retracted attitude if the chair's user places too much downward force on the leg rest, e.g., if the chair's user exerts too much force on the leg rest with his legs. This is undesirable to the chair's user because, if the problem is severe enough, the chair's user must continually be reraising or re-extending the leg rest to the fully extended attitude. The drift problem with a manually operable leg rest linkage assembly also may occur when the leg rest is in the retracted or storage attitude. It is considered desirable to maintain the leg rest in a predetermined storage position, e.g., flush with the front face of the chair, at all times when the leg rest is retracted. However, and with certain leg rest linkage assemblies, the leg rest may tend to drift or extend outward from its fully retracted attitude after it has been located in that storage position. This is considered commercially undesirable from an aesthetic standpoint.

It is known to the prior art to incorporate a tension spring in connection with a leg rest linkage assembly for a chair's leg rest in an effort to maintain the leg rest in the fully extended attitude, and in an effort to maintain the leg rest in the fully retracted attitude, when that leg rest has been so positioned by the chair's user. However, the tension spring provided for the leg rest linkage assembly requires extra effort on the part of a chair's user when the leg rest is manually extended or manually retracted in order to remove the leg rest linkage assembly from the fully extended or fully retracted positions. In other words and with the tension spring incorporated in the leg rest linkage assembly, operation of that leg rest between the extended and retracted attitudes may prove cumbersome to some users and difficult to others, all of which is undesirable from a satisfied customer standpoint. Indeed and for certain users, e.g., the elderly, the extra strength required to operate the manual operator for the leg rest linkage assembly may make operation of that leg rest assembly especially difficult.

Accordingly, it has been one objective of this invention to provide a novel control linkage for a leg rest linkage, the control linkage being operable to lock up the leg rest linkage in the fully extended or use attitude, as well as to lock up the leg rest linkage in the fully retracted or storage attitude, by moving one or more links in that control linkage into an over center position in each of the leg rest linkage's extended and retracted attitudes.

It has been another objective of this invention to provide a novel leg rest linkage assembly for a chair's leg rest in which the chair's user may translate manually the chair's leg rest between extended and retracted positions, the leg rest linkage assembly including a control linkage that is operable to allow the chair's user to position manually one or more links of the control linkage in an over-center attitude in both the extended and retracted positions of the leg rest linkage assembly, the over center control linkage attitude serving to lock up the leg rest linkage assembly in both the extended and retracted positions, thereby preventing drift of the chair's leg rest out of the extended attitude as well as out of the retracted attitude once the leg rest has been located in either position.

In accord with these objectives, the leg rest linkage assembly of this invention is directed to a chair's movable leg rest. A novel control linkage functions to lock up the leg rest linkage when the leg rest is fully extended, and to lock up the leg rest linkage when the leg rest is fully retracted, so that the leg rest does not 'drift' out of either the extended or retracted attitudes after being placed therein. The control and leg rest linkages are locked up in the leg rest extended attitude by positioning certain of the control linkage's links in an over center position relative to the pivot points of those links, and are locked up in the retracted attitude by positioning certain other of the control linkage's links in an over center position relative to the pivot points of those other links. The leg rest linkage is extended and retracted by an operator, e.g., a handle, connected to the control linkage.

Other objectives and advantages of this invention will be more apparent from the following detailed description taken in conjunction with the drawings in which.

Figure 3:
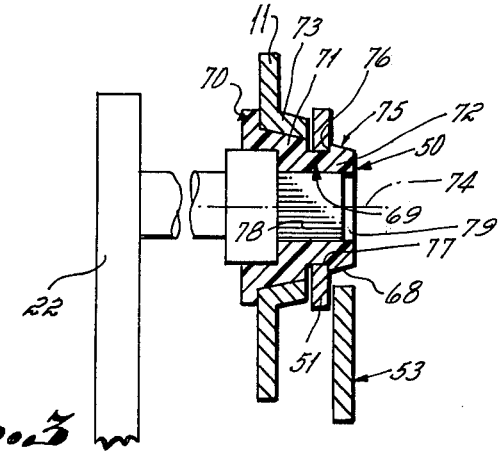
FIG. 3 is a cross-sectional view taken along line 3—3 of FIG. 1.
Figure 2:
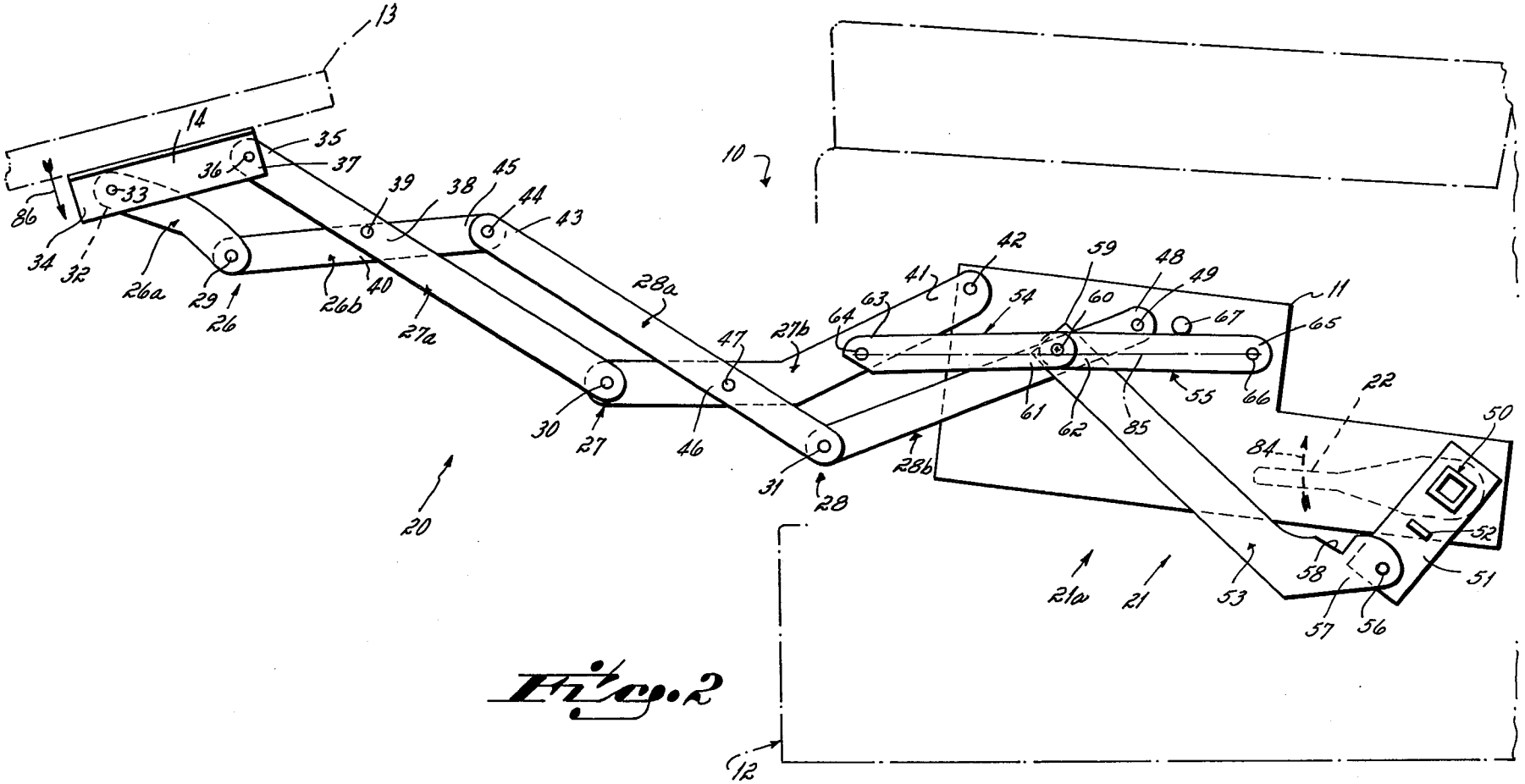
FIG. 2 is a view similar to FIG. 1 but illustrating the leg rest linkage assembly in the fully extended attitude.
Figures 4, 5, 6:
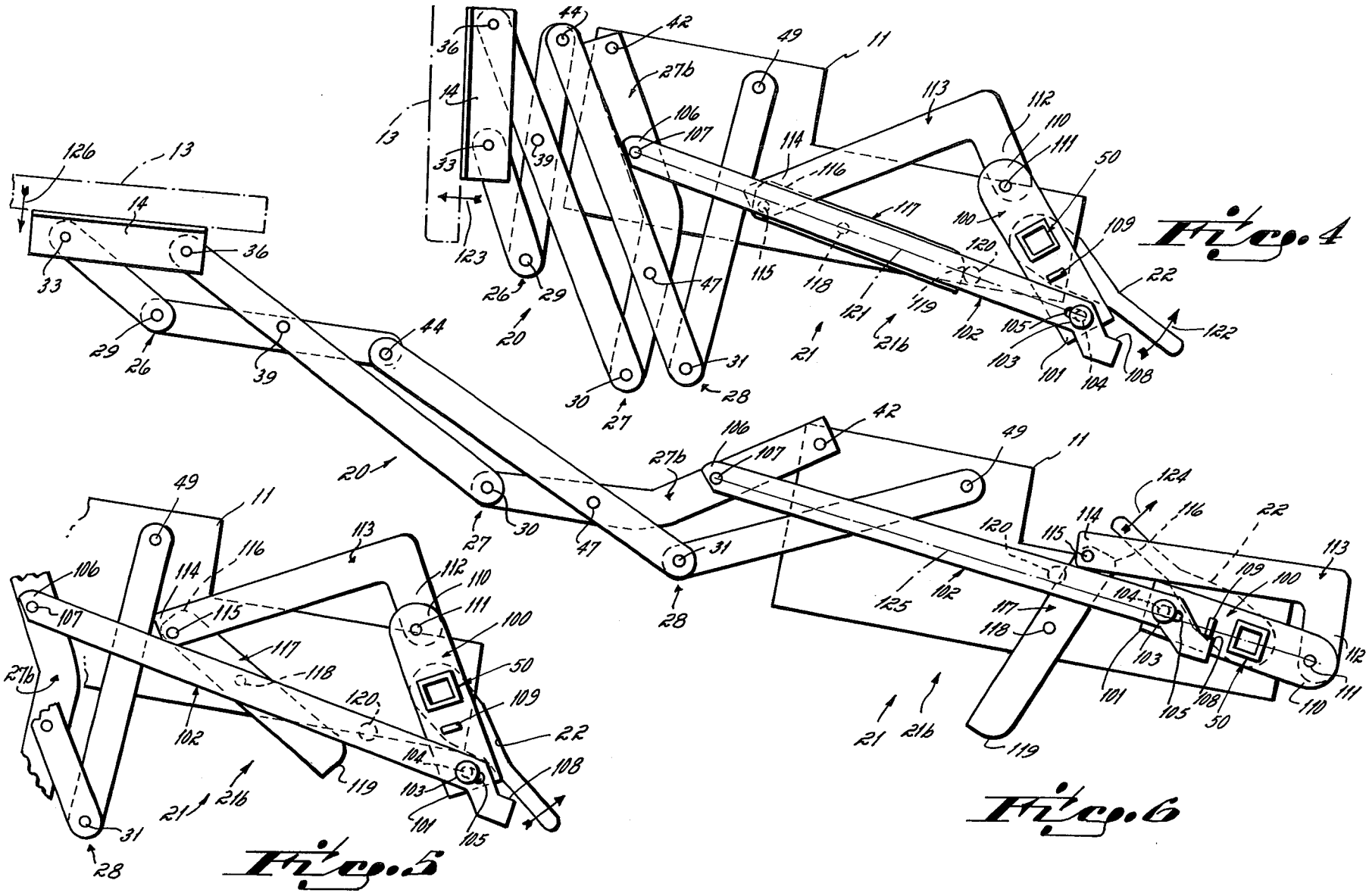
FIG. 4 is a side view similar to FIG. 1 but illustrating a second embodiment of a leg rest linkage assembly in accord with the principles of this invention, the leg rest linkage assembly being illustrated in the fully retracted attitude.

FIG. 5 is a side view of a control linkage portion of the leg rest linkage assembly embodiment illustrated in FIG. 3, the control linkage being illustrated in an intermediate attitude between the fully retracted attitude and the fully extended attitude; and FIG. 6 is a side view similar to FIG. 2 but illustrating the second embodiment of the leg rest linkage assembly in the fully extended position.

Figure 1:
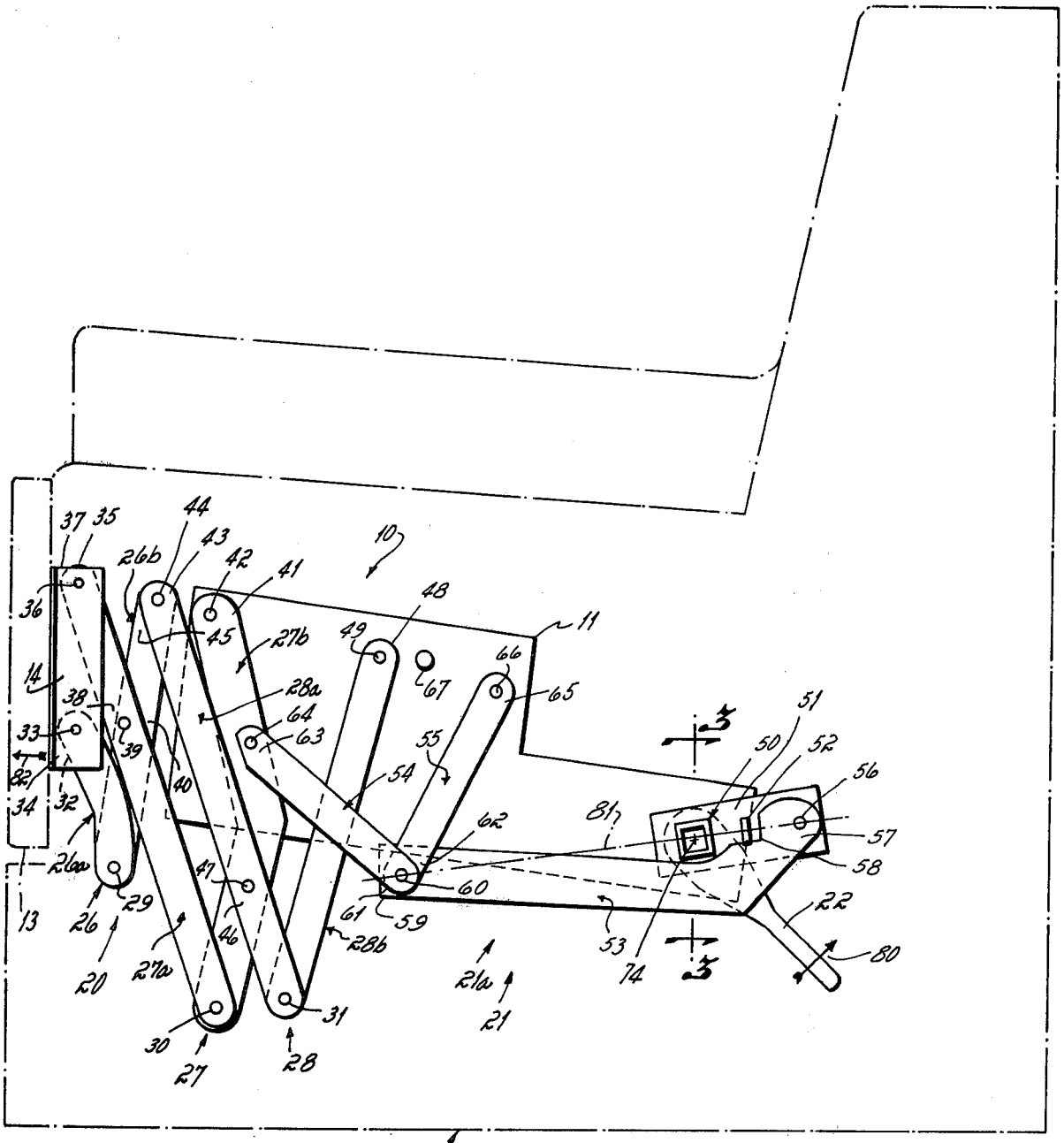
FIG. 1 is a side view illustrating a first embodiment of a leg rest linkage assembly in accord with the principles of this invention, the leg rest linkage assembly being illustrated in the fully retracted attitude.

A leg rest linkage assembly 10, in accord with the general principles of this invention, is illustrated in FIGS. 1 and 2. As shown in those Figures, the leg rest linkage assembly 10 is all mounted on baseplate 11, the baseplate being affixed to framework 12 (shown in phantom lines) of a chair by fastener means not shown. The chair's leg rest 13 is carried on the leg rest's mounting plate 14, that mounting plate being interconnected with the baseplate 11 and, hence, with the chair's framework 12, through the leg rest linkage assembly 10 of this invention. Although FIGS. 1 and 2 illustrate the framework 12 of the chair in phantom outline only, it will be understood that such framework is suitably adapted for receiving appropriate spring elements, cushioning, upholstery, and the like, for completion of a saleable product. In other words, the springs, cushioning and covering of the chair have been eliminated for clarity of illustration of the leg rest linkage assembly 10 in accord with the principles of this invention.

Each embodiment of the leg rest linkage assembly 10 (i.e., the FIGS. 1–3 first embodiment, and the FIGS. 4–6 second embodiment) basically includes a leg rest linkage 20 and a control linkage 21, the two linkages being interconnected together one with another. The leg rest linkage 20 connects that leg rest's mounting plate 14 with the baseplate 11, and the control linkage 21 connects the leg rest linkage 20 with a manual operator, e.g., a handle 22, as illustrated in the Figures. The control linkage 21 is also connected to the baseplate 11 of the leg rest linkage assembly 10.

The leg rest linkage 20 is of the same structure for both the FIGS. 1–3 first embodiment, and the FIGS. 4–6 second embodiment, of the leg rest linkage assembly 10. The leg rest linkage 20 is in the form of a triple V lazy tong linkage of the conventional overlap type. The arms 26*a*, 26*b*, and 27*a*, 27*b*, and 28*a*, 28*b* of each pair 26, 27, 28 of links in the triple V lazy tong linkage are pivotally connected together at adjacent ends as at points 29, 30, 31, respectively. The first V-link pair 26 has free end 32 of first link 26*a* pivotally connected as at 33 to bottom end 34 of the leg rest's mounting plate 14. The second V link pair 27 has free end 35 of first link 27*a* pivotally connected as at 36 to the top end 37 of the leg rest's mounting plate 14, and has a mid-portion 38 pivotally connected as at 39 to a mid-portion 40 of the first V-link pair's second link 26*b*. The free end 41 of the second V-link pair's second link 27*b* is pivotally connected as at 42 to the baseplate 11 for the leg rest linkage assembly 10. The third V-link pair 28 has a free end 43 of first link 28*a* pivotally connected as at 44 to the free end 45 of the first V-link pair's second link 26*b*, and has a mid-portion 46 pivotally connected as at 47 midway between the ends of the second link 27*b* in the second V-link pair 27. The third V-link pair's second link 28*b* has its free end 48 pivotally connected as at 49 to the baseplate 11.

When the leg rest linkage assembly 10 is in the retracted attitude, the V-link pairs 26–28 are in a generally upright overlapped-V configuration as illustrated in FIG. 1, all being interconnected one with another, so as to orient the leg rest's mounting plate 14 and, hence, the leg rest 13, in a generally vertical or upright attitude. When the leg rest linkage assembly 10 is in the extended attitude, the V-link pairs 26–28 are in a flat V configuration as illustrated in FIG. 2 so as to orient the leg rest's mounting plate 14 and, hence, the leg rest 13, in a generally horizontal or use attitude. The leg rest linkage 20, therefore, is that part of the leg rest linkage assembly 10 which retracts the leg rest 13 to the vertical retracted position illustrated in FIG. 1, and which extends the leg rest to the extended generally horizontal attitude illustrated in FIG. 2.

A first embodiment of the control linkage 21 portion of the leg rest linkage assembly 10 is illustrated in FIGS. 1–3. As shown in those Figures, the control linkage 21*a* includes a drive shaft 50 rotatably carried in baseplate 11. The drive shaft 50 mounts a drive link or arm 51 which extends radially outward therefrom. The drive arm 51 is provided with a retract stop in the form of a tab 52 struck therefrom, the function of the retract stop being described in detail below. The drive shaft also mounts an operator which, in this embodiment, is in the nature of a handle 22 adapted to be grasped manually by the chair's user. Both the drive arm 51 and the handle 22 are fixed to the drive shaft 50. The control linkage 21*a* further includes an operator arm linkage which includes primary operator link or arm 53, and secondary links or operator arms 54, 55, the secondary arms alone defining a V-link pair, and the secondary arms and primary arm defining a V-linkage. The primary operator arm 53, in the general configuration of a bellcrank, is pivotally connected as at 56 at end 57 to the drive arm 51, that same end 57 also being provided with a notch 58 therein adapted to cooperate with the drive arm's retract stop 52 as explained in detail below. The other end 59 of the primary operator arm 57 is pivotally connected, as at 60 and on the same pivot axis 60, to adjacent ends 61, 62 of the two secondary operator arms 54, 55. The free end 63 of secondary operator arm 54 is pivotally connected as at 64 to the second link 27*b* of the second V-link pair 27 in the leg rest linkage 20 between the pivot points 42, 47. The free end of 65 of the secondary operator arm 55 is pivotally connected as at 66 to the baseplate 11. Thus, the primary operator arm 53 connects the drive arm 51 with the leg rest linkage 20 through the secondary operator arms 54, 55. An extend stop in the form of a pin 67 is permanently mounted to the baseplate 11 above the secondary operator arm 55.

The interconnection of the drive shaft 50 with the baseplate 11 is more particularly illustrated in FIG. 3. As shown in that Figure, the drive shaft 50 has a sleeve portion with an outwardly extending flange 70 on one end thereof, the sleeve portion including a cylindrical center section 71 and a square end section 72. The cylindrical center section of the drive shaft 50 is received in bearing sleeve 73 defined in the baseplate 11, thereby defining drive shaft axis 74. The square end section 72 of the drive shaft 50 includes spring fingers 75 having lips 76 on the ends thereof, those fingers 75 also constituting part of the drive shaft 50. The spring fingers 75 are angled as at 76 at the leading end thereof, thereby permitting the drive arm 50 with the square hole 77 therein to be received in snap-fit relation on the shaft 50. Thus, the drive arm 51 is captured on the drive shaft 50 between the shaft's lips 26 and the baseplate's bearing sleeve 73. The handle 22 is, of course, provided with a square shaft 78 adapted to interfit in square bore 79 defined in the drive shaft 50.

In use of the first embodiment of the leg rest linkage assembly 10, the retracted attitude is illustrated in FIG. 1. The leg rest linkage assembly 10 is located in the FIG. 1 retracted attitude by rotating the operator handle 22 in the counterclockwise direction as shown in FIG. 1 by phantom arrow 80. In this retracted attitude, the primary operator arm 53 functions as a retract latch link adapted to cooperate with the retract stop 52 on the drive arm 51 to position the control linkage 21*a* so that the leg rest linkage 20 is locked up in the retracted attitude, i.e., so that the leg rest 13 cannot drift outwardly or forwardly toward the extend attitude illustrated in FIG. 2. The leg rest linkage 20 is so locked up because phantom latch line 81 which passes through the pivot points 60, 56 of the primary operator arm 53 lies on that side of the drive shaft axis 74 opposite to the operator arm 53 itself, i.e., opposite to that which would permit extension of the leg rest 13. In other words, and in this locked up and retracted attitude where the primary operator arm 53 is stopped against the retract stop 52 on the drive arm 51, the drive arm 51 is prevented from further counterclockwise movement (as illustrated in FIG. 1) and this locks up the control linkage 21*a* and leg rest linkage 20 in the fully retracted attitude. Once positioned in the locked up and retracted attitude, the drive arm 51 will not tend to, and is not able to, rotate clockwise as shown in FIG. 1 (i.e., the leg rest 13 will not tend to drift toward the extended attitude in response to any outward force 82 thereon) until the phantom latch line 81 that interconnects the primary operator arm's two pivot points 60, 56 passes back over center relative to the drive shaft's axis 74. This is because any extension force 82 exerted on leg rest 13 when the leg rest is fully retracted would tend to rotate the drive arm 51 counterclockwise in light of the phantom latch line 81 position but this is not permitted because of the retract stop 52 as previously mentioned. In the retract attitude in the first control linkage 21*a* embodiment, therefore, the primary operator arm 53 also functions as a retract latch link which locks up the leg rest linkage assembly 10 in the retracted attitude in cooperative relation with the drive arm 51 and the leg rest linkage 20.

When it is desired to extend the first embodiment of the leg rest linkage assembly 10 from the locked up and retracted attitude into the extended attitude, the manual handle 22 is pivoted in the clockwise direction as illustrated by phantom arrow 84 in FIG. 2. As the handle is pivoted clockwise from the FIG. 1 position toward the FIG. 2 position, the over center attitude of the control linkage 21*a* illustrated in FIG. 1 is released, i.e., the phantom latch line 81 that connects the primary operator arm's pivot points 60, 56 passes over onto the same side of the drive shaft axis 74 as that operator arm 53 itself, thereby permitting the primary operator arm 53 and the two secondary operator arms 54, 55 to thrust the leg rest linkage 20 from the retracted attitude into the extended attitude. The motive power for the thrust of the leg rest linkage 20 from the retracted to the extended attitude is provided manually through the handle to the drive arm 51, through the drive arm to the primary operator arm 53, through the primary operator arm to the secondary operator arms 54, 55 and through the secondary operator arms to the leg rest linkage 20. The leg rest linkage 20 is extended by operation of handle 22, i.e., the handle is rotated clockwise, until the secondary operator arms 54, 55 pass over center and abut extend stop 67. Note the phantom latch line 85 that interconnects the two free end pivot points 64, 66 of the secondary operator arms 54, 55. As illustrated in FIG. 2, when the pivotal interconnection 60 of the primary operator arm 53 with those two secondary operator arms 54, 55 passes over or beyond that phantom latch line 85, the leg rest linkage 20 is locked up in the extended attitude, and the control linkage 21*a* is maintained in the locked up attitude by virtue of the secondary operator arm 55 abutting against the extend stop 67. In other words, and if a downward force, as shown by phantom arrow 86, is exerted on the leg rest 13 when the leg rest is in the extended attitude as illustrated in FIG. 2, that downward force 86 is transmitted through leg rest linkage 20 to the secondary operator arms 54, 55 which, because same are in the over-center attitude, causes the secondary operator arm 55 to abut with that much greater force against the extend stop 67. Thus, and in the extended position, the secondary operator arms 54, 55 function as latch links in that they cooperate with the extend stop 67 to maintain the leg rest linkage 20 locked up in the extended attitude.

A second embodiment of the leg rest linkage assembly of this invention is illustrated in FIGS. 4–6. The leg rest linkage 20, the baseplate 11, the drive shaft 50, and the handle 22 components of the second embodiment are identical to the same components for the first embodiment and, hence, have been provided with the same reference numbers. The difference between the second embodiment and the first embodiment of the leg rest linkage assembly is in the control linkage 21.

The second embodiment of the control linkage 20*b*, as shown in FIGS. 5 and 6, includes a drive arm 100 received on the drive shaft 50 and extending radially outward from opposite sides of that shaft 50. The drive arm 100 is pivotally connected at one end 101 with primary operator link or arm 102 as at 103, that pivotal connection being by way of headed pin 104 and slot 105. The primary operator arm 102 is pivotally connected at the other end 106 as at 107 with second arm 27*b* of the second V-linkage pair 27 in the leg rest linkage 20. Hence, in this second control linkage 20*b* embodiment, the primary operator arm 102 is directly connected between the drive arm 100 and the leg rest linkage 20 whereas in the first control linkage 21*a* embodiment the primary operator arm 53 is directly connected to the drive arm but is indirectly connected to the leg rest linkage 20 through secondary operator arms 54, 55. The primary operator arm 102 also includes a seat 108 adapted to cooperate with extend stop 109 mounted on the drive arm 100.

The drive arm's end 110, located on the other side of drive shaft axis 74 from end 101, is pivotally connected as at 111 with one end 112 of a bellcrank arm 113. The other end 114 of the bellcrank arm 113 (which is, in effect, a first retract latch link) is pivotally connected as at 115 to one end 116 of a second retract latch link 117. The latch links 113, 117 are secondary links. The second retract latch link 117 is pivotally connected as at 188 to the baseplate 11, and the other end 119 of the retract latch link is configured and sized to cooperate with retract stop 120 mounted on the primary operator arm 102.

In use, and when it is desired to dispose the leg rest linkage assembly 10*b* in the retracted attitude, the drive shaft 50 is rotated counterclockwise (see arrow 122) by the manual handle 22 as illustrated in FIG. 3 until pivotal connection 115 between the primary 113 and secondary 117 retract latch links is located over center relative to the phantom latch line 121 connecting the opposite pivotal ends 107, 103 of the primary operator arm 102. In this locked up attitude, any outward or extension force exerted on the leg rest 13 in direction illustrated by phantom arrow 121, i.e., any force tending to move the leg rest toward the extended attitude shown in FIG. 5, tends to promote further counterclockwise rotation of the retract latch links 113, 117 about drive shaft axis 74, which rotation is prevented by abutting relation of the free end 119 of the secondary retract latch link 117 with the retract stop 120, thereby maintaining the leg rest in the vertical storage attitude. Therefore, and in the fully retracted attitude, the leg rest linkage assembly **10*b* is locked up in an over-center position illustrated in FIG. 4 in that the pivotal connection 115 of the first retract latch link 113 with the second retract latch link 117 is disposed over the phantom latch line 121 that extends between the pivotal connections 107, 103 of the primary operator arm 102. The retract latch links 113, 117 are prevented from further counterclockwise motion (as illustrated in FIG. 3) about drive shaft axis 74 in the over-center position shown in that Figure by contact of free end 119 of the retract latch link 117 with the retract stop 120 carried on the primary operator arm. In this over-center position, any outward force (depicted by arrow 121) on leg rest 13 tends to rotate the latch links 113, 117 counterclockwise as shown in FIG. 4, but this counterclockwise rotation about drive shaft axis 74 is resisted as previously mentioned to define the locked up position. This locked up position of control linkage 21*b* is achieved, as previously mentioned, by rotating the handle 22 counterclockwise (see arrow 122) until retract latch link 117 engages pin 120**.

When it is desired to translate the control linkage **21*b* and, hence, the leg rest linkage assembly 10*b*, from the retracted attitude illustrated in FIG. 3 toward the extended attitude shown in FIG. 6, the operator's handle 22 is pivoted in a clockwise direction illustrated by arrow 122. FIG. 5 illustrates the control linkage 21*b* in a position intermediate the fully retracted attitude and fully extended attitude of the leg rest 13. When the leg rest achieves the fully extended attitude, as illustrated in FIG. 6, the control linkage 21*b* and leg rest linkage 20 are fully locked up because pivot point 103 is located over center relative to the phantom latch line 124 connecting the end pivot point 107 of the primary operator arm 102 with the leg rest linkage 20, and the drive shaft of axis 74. In this over-center attitude, the primary operator arm's seat 108 is seated against the extend stop 109 on the drive arm 100 to maintain the control linkage 21*b* in that over-center attitude. When downward force is exerted on the leg rest 13 in the direction illustrated by arrow 125 with the leg rest linkage assembly 10*b* in the locked up and extended attitude, such is translated back to the primary operator arm 102 through the leg rest linkage 20 and, with the primary operator arm 102 in the over-center attitude illustrated in FIG. 6, tends to promote clockwise rotation of the drive arm 100. But this clockwise rotation of the drive arm 100 is resisted because seat 108 of the primary operator arm 102 is seated against the extend stop 109** fixed to the drive arm, thereby prohibiting further clockwise rotation and thereby locking up the leg rest linkage assembly in the fully extended attitude.

Having described in detail the preferred embodiments of my invention, what I desire to claim and protect by Letters Patent is:

1. A leg rest linkage assembly for a chair's leg rest, said leg rest linkage assembly being adapted to translate said leg rest between a fully extended use position and a fully retracted storage position, said leg rest linkage assembly comprising a leg rest linkage structured to move said leg rest between said extended and retracted positions, said leg rest linkage being connected between said leg rest and a frame for said chair, a handle connected to a drive shaft, said handle being accessible for manual operation by the chair's user, rotation of said drive shaft being provided manually through use of said handle, and a control linkage directly connected in a mechanical linkage series between said drive shaft and said leg rest linkage for controlling movement of said leg rest linkage between extended and retracted positions in response to manual operation of said handle, said control linkage being structured to lock up in a first over-center position when said drive shaft is rotated in one of a clockwise and counterclockwise direction for locking said leg rest in said retracted position, and said control linkage being structured to lock up in a second over-center position when said drive shaft is rotated in the other of said clockwise and counterclockwise directions for locking said leg rest in said extended position, said locked up control linkage preventing drift of said leg rest out of said retracted position toward said extended position in response to a force exerted on said leg rest in the extension direction, and preventing drift of said leg rest out of said extended position toward said retracted position in response to a force exerted on said leg rest in the retraction direction, when no user is seated in said chair.

2. A leg rest linkage assembly as set forth in claim 1, said leg rest linkage including at least two V-link pairs, said V-link pairs being connected together in a lazy tong type linkage, said at least one of said V-link pairs being connected at one end to said leg rest and at least one other of said V-link pairs being connected at one end to the chair's frame.

3. A leg rest linkage assembly as set forth in claim 1 including a drive shaft connected to said handle and adapted to be rotated by the chair's user, said control linkage being connected between said drive shaft and said leg rest linkage, said control linkage being structured to lock up said leg rest linkage assembly in a first over-center position when said drive shaft is rotated in one of a clockwise and counterclockwise direction for positioning and locking up said leg rest in the retracted attitude, and said control linkage being structured to lock up said leg rest linkage assembly in a second over-center position when said drive shaft is rotated in the other of said clockwise and counterclockwise directions for positioning and locking up said leg rest in the extended attitude.

4. A leg rest linkage assembly as set forth in claim 1 including said handle being connected to a drive shaft, said handle being accessible for manual operation by the chair's user, rotation of said drive shaft being provided manually through use of said handle.

5. A leg rest linkage assembly as set forth in claim 1 including an extend stop and a retract stop, one of said stops cooperating with said control linkage to stop and locate said control linkage in the first over-center position and the other of said stops cooperating with said control linkage to stop and locate said control linkage in the second over-center position.

6. A leg rest linkage assembly as set forth in claim 1, said control linkage including a drive arm connected to said drive shaft, and a primary operator arm connected at one end to said drive arm and at the other end to said leg rest linkage, said drive arm and said primary operator arm cooperating to establish said leg rest linkage assembly in one of said fully extended and fully retracted attitudes, thereby locking up said leg rest linkage assembly in that attitude.

7. A leg rest linkage assembly as set forth in claim 6 including at least two secondary links connected with one of said primary operator arm and said drive arm, said secondary links cooperating with said primary operator arm to establish said leg rest linkage assembly in the other of said fully retracted and fully extended positions, thereby locking up said leg rest linkage assembly in that other attitude.

8. A leg rest linkage assembly as set forth in claim 1, said control linkage including a drive arm connected to said drive shaft, a primary arm pivotally connected at one end to said drive arm, two secondary arms pivotally connected on a common axis to the other end of said primary arm, the free end of one of said secondary arms being pivotally connected to the chair's frame and the free end of the other of said secondary arms being pivotally connected to said leg rest linkage, and a retract stop fixed to said drive arm, and an extend stop fixed to the chair's frame, the pivot connection of said primary arm with said secondary arms being located over-center relative to a phantom latch line connecting the free end pivot connections of said secondary arms when said leg rest is fully extended, said control linkage being stopped in said extend over-center position by said extend stop, and a phantom latch line connecting the two end pivot connections of the primary operator arm being located over-center relative to the drive shaft's axis when the leg rest linkage is fully retracted, said control linkage being stopped in said retract over-center position by said retract stop.

9. A leg rest linkage assembly as set forth in claim 1 said control linkage including a drive arm connected to said drive shaft, said drive arm extending radially relative to said drive shaft on both sides thereof, a primary arm pivotally connected at one end to one end of said drive arm, and pivotally mounted at the other end to said leg rest linkage, a first secondary arm pivotally connected at one end to the other end of said drive arm, a second secondary arm pivotally connected at one end to the other end of said first secondary arm, and pivotally connected at the other end to the chair's frame, and a retract stop fixed to said primary arm, and an extend stop fixed to said drive arm, the pivot connection of said primary arm with said drive arm being located over-center relative to phantom latch line drawn through the pivot connection of said primary operator arm with said leg rest linkage and said drive shaft axis when said leg rest is in the extended attitude, said control linkage being stopped in said extended attitude by said extend stop and the pivot connection of said first and second secondary arms one with another being located over-center relative to a phantom latch line that includes the pivot connection of said primary arm with said drive arm and the pivot connection of said primary arm with said leg rest linkage when said leg rest is in the retracted attitude, said control linkage being stopped in said retracted attitude by said retract stop.

* * * * *